US007784928B2

(12) United States Patent
Okamoto

(10) Patent No.: US 7,784,928 B2
(45) Date of Patent: Aug. 31, 2010

(54) PRINTER

(75) Inventor: Tsugio Okamoto, Kani (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 808 days.

(21) Appl. No.: 11/086,303

(22) Filed: Mar. 23, 2005

(65) Prior Publication Data

US 2005/0212883 A1 Sep. 29, 2005

(30) Foreign Application Priority Data

Mar. 23, 2004 (JP) ..... 2004-084852

(51) Int. Cl.
*B41J 2/01* (2006.01)
*B41J 29/38* (2006.01)

(52) U.S. Cl. ..... 347/101; 347/14; 347/16; 347/104

(58) Field of Classification Search ..... 347/16, 347/14, 19, 101, 104, 105, 108, 8
See application file for complete search history.

(56) References Cited

U.S. PATENT DOCUMENTS 3,383,952 A * 5/1968 Christenson ..... 475/24
4,620,807 A 11/1986 Polit
4,873,541 A * 10/1989 Hirose et al. ..... 347/118
5,019,871 A * 5/1991 Takeda et al. ..... 399/66
5,136,307 A * 8/1992 Uchida et al. ..... 346/136
5,274,399 A 12/1993 Uchida et al.
5,462,371 A * 10/1995 Beretta et al. ..... 400/569
5,467,709 A * 11/1995 Salomon ..... 101/93
5,555,082 A 9/1996 Tanaka et al.
5,567,068 A * 10/1996 Egashira et al. ..... 400/625
5,580,042 A * 12/1996 Taniguro et al. ..... 271/274
5,615,872 A * 4/1997 Mochimaru ..... 271/3.14
5,619,240 A * 4/1997 Pong et al. ..... 347/103
5,627,570 A * 5/1997 Hiramatsu et al. ..... 347/19

(Continued)

FOREIGN PATENT DOCUMENTS

JP 01008146 A * 1/1989

(Continued)

OTHER PUBLICATIONS

Relevant Portions of European Search Report 05251727.3.

(Continued)

*Primary Examiner*—Stephen D Meier
*Assistant Examiner*—Leonard S Liang
(74) *Attorney, Agent, or Firm*—Banner & Witcoff, Ltd

(57) ABSTRACT

The unjamming process is conducted through an opening formed on a lateral side of a housing of the printer. A recording medium conveying unit of the printer does not get exposed to outside. The printer also inhibits inaccurate ejection of ink from recording heads because of the unjamming process. For the unjamming process, the recording medium conveying unit is moved away from head surfaces. This constitution prevents vibration or shock on the recording heads when a recording paper is removed, prevents breakage of menisci formed on respective nozzles of the recording heads, and furthermore prevents ink from being pushed outside of the nozzles, or inhaled toward an ink tank because positional relation between the recording heads and the ink tank does not change. Therefore, inaccurate control over ejection of ink can be inhibited.

20 Claims, 8 Drawing Sheets

U.S. PATENT DOCUMENTS

| | | | | | |
|---|---|---|---|---|---|
| 5,808,647 | A | * | 9/1998 | Kurata et al. | 347/104 |
| 5,823,696 | A | * | 10/1998 | Harris et al. | 400/708 |
| 6,005,593 | A | | 12/1999 | Yoshinaga et al. | |
| 6,092,891 | A | * | 7/2000 | Okubo et al. | 347/104 |
| 6,125,251 | A | | 9/2000 | Shiraishi et al. | |
| 6,161,917 | A | * | 12/2000 | Igarashi et al. | 347/22 |
| 6,199,855 | B1 | * | 3/2001 | Choeng et al. | 271/122 |
| 6,647,228 | B2 | | 11/2003 | Nakamura et al. | |
| 6,896,253 | B2 | * | 5/2005 | Hanabusa | 271/117 |
| 7,107,798 | B2 | * | 9/2006 | Vaidhyanathan et al. | 68/19 |
| 7,187,901 | B2 | * | 3/2007 | Ohashi | 399/388 |
| 2005/0046686 | A1 | * | 3/2005 | Iwakura et al. | 347/104 |
| 2005/0275706 | A1 | * | 12/2005 | Takagi et al. | 347/104 |

FOREIGN PATENT DOCUMENTS

| | | | | |
|---|---|---|---|---|
| JP | 64040848 | U | | 3/1989 |
| JP | 03-243356 | | | 10/1991 |
| JP | 04-149570 | | | 5/1992 |
| JP | 06-001471 | | | 1/1994 |
| JP | 10301462 | A | * | 11/1998 |
| JP | 2000029347 | A | | 1/2000 |
| JP | 2002214874 | A | | 7/2002 |
| JP | 2003-94744 | | | 4/2003 |

OTHER PUBLICATIONS

Notification of First Office Action dated Dec. 8, 2006 in Chinese Application No. CN2005-10592-12.8.

Office Action issued Sep. 8, 2009 in corresponding Japanese Patent Application No. 2004-084852.

* cited by examiner

PRINTER

CROSS-REFERENCE TO RELATED APPLICATIONS

This application claims the benefit of Japanese Application No. 2004-084852 filed on Mar. 23, 2004 in the Japanese Patent Office, the disclosure of which is incorporated herein by reference.

BACKGROUND

This invention relates to a printer that forms an image on a recording paper by ejecting ink drops while conveying the recording paper.

Conventionally, printers comprise recording heads and a recording medium conveying unit that conveys a recording paper along head surfaces of the recording heads, and recording of an image on a recording paper is conducted by ejecting ink drops from the recording heads while the recording paper being conveyed by the recording medium conveying unit.

In this type of a printer, owing to a structure thereof, a recording paper under conveyance sometimes gets jammed between the recording heads and the recording medium conveying unit. The printer needs to be designed so as to allow an unjamming process to remove jammed recording paper.

A Japanese Unexamined Publication No. 2003-94744 (for example, paragraph [0121]) discloses an example of the constitution of a printer wherein the unjamming process can be conducted. In this constitution, a upper chassis 2 of the printer wherein recording heads are disposed is lifted up to make a vertically large space between the recording heads and the recording medium conveying unit (conveyer belt unit 31). Thereby, the unjamming process can be easily conducted.

SUMMARY

However, in the above-described type of constitution wherein the space between the recording heads and the recording medium conveying unit is largely opened by lifting up the upper chassis of a printer, the recording medium conveying unit gets exposed to outside of the printer, and dust enters from outside during the unjamming process.

Moreover, because of the constituted wherein the upper chassis of the printer is lifted up, large vibration or shock is applied on the recording heads when the upper chassis of the printer is lifted up, or when the upper chassis is replaced to an original position. Consequently, there is possibility that ejection of ink drops from the head surfaces cannot be conducted accurately. For example, if the printer is an inkjet printer, for accurate control over ejection of ink drops, menisci are formed on an outlet of ink drops of respective nozzles formed on the head surfaces in a manner ready for ejection at any time. In such an inkjet printer, if large vibration or shock on the recording heads is applied corresponding to the unjamming process, it is possible that menisci on respective nozzles are broken, and as a result, ink drops cannot be ejected.

The present invention was made in order to solve the above and other issues, and one of the purposes is to provide a skill to inhibit dust from entering from outside during an unjamming process to inhibit inaccurate ejection of ink drops from recording heads because of an unjamming process.

A printer of one aspect of the present invention comprises: recording heads for image recording on a recording medium; a recording medium conveying unit that conveys the recording medium along head surfaces of the recording heads; a displacement device capable of displacing the recording medium conveying unit to a proximate position proximate to the head surfaces and to a remote position away from the head surfaces; and a housing that stores the recording heads, the recording medium conveying unit, and the displacement device. In the printer, an opening is formed on a lateral side of the housing. The housing comprises a cover that can cover/uncover the opening through the opening and allow the recording medium to be removed outside when the recording medium conveying unit is at the remote position.

In the printer constituted as above, the recording heads and recording medium conveying unit are parted, and a recording medium between the recording medium conveying unit and the head surfaces can be removed. Removal of a recording medium, i.e. an unjamming process, is conducted through the opening formed on the lateral side of the housing. Thus, the recording medium conveying unit is not exposed to outside. Consequently, compared to a constitution of a printer wherein the upper chassis on which the recording heads are disposed is lifted up to make a vertically large space between the recording heads and the recording medium conveying unit, it is possible to inhibit dust from entering inside of the printer.

Moreover, in the printer, an unjamming process can be conducted by moving the recording medium conveying unit away from the head surfaces. Therefore, unlike a constitution wherein the recording head is displaced, it is possible to prevent large vibration or shock on the recording heads when removal of a recording medium is conducted.

This constitution is very effective especially in an inkjet printer wherein ink drops are ejected from recording heads. For accurate control over ejection of ink drops, it is necessary, in an inkjet printer, that menisci are always formed on outlets of ink drops on respective nozzles provided on the recording heads so that ink drops are always ready to be ejected. If large vibration or shock is applied to the recording heads during an unjamming process, menisci in respective nozzles are broken, and ejection of subsequent ink drops might not be controlled accurately. With the constitution of the present printer wherein the recording medium conveying unit is moved away from the head surfaces, large vibration or shock is less likely applied to the recording heads during an unjamming process. Therefore, menisci in the nozzles can be maintained, and ejection of ink drops can be accurately controlled.

Moreover, if a printer has a constitution wherein respective nozzles of recording heads are connected to an ink tank via supply path of respective ink, pressure applied on menisci differ depending on height difference (head difference) between the ink tank and the nozzles. When positional relation between the recording heads and the ink tank changes, pressure within the supply path fluctuates. Depending on the fluctuation, menisci cannot be maintained. Consequently, subsequent ejection of ink drops cannot be accurately controlled. However, with the printer according to the present invention, positional relation between the recording heads and the ink tank do not change during an unjamming process. Therefore, menisci are always maintained to be ready for ejection, and ejection of ink drops can be accurately controlled.

Furthermore, the printer according to one aspect of the present invention comprises a cover that can cover/uncover the opening. By keeping the opening covered with this cover except during an unjamming process, it is possible to reliably inhibit dust from entering inside of the printer.

Timing to displace the recording medium conveying unit by the above-described displacement device is not limited to specific timing. Displacement to the remote position or to the proximate position can be conducted, for example, corresponding to a user's operation.

BRIEF DESCRIPTION OF THE DRAWINGS

The invention will now be described below, by way of example, with reference to the accompanying drawings.

DETAILED DESCRIPTION OF THE PREFERRED EMBODIMENT

Figure 1A:
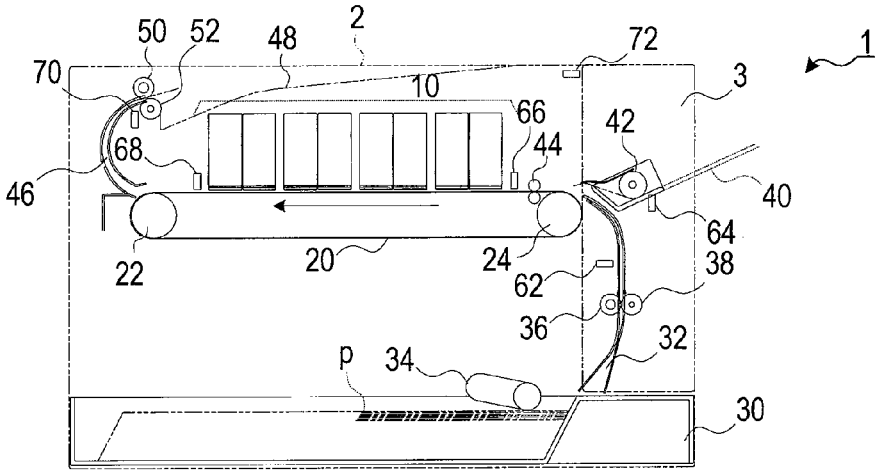
FIGS. 1A to 1C are longitudinal sectional views showing an internal structure of a printer of an embodiment according to the present invention.
Figure 1B:
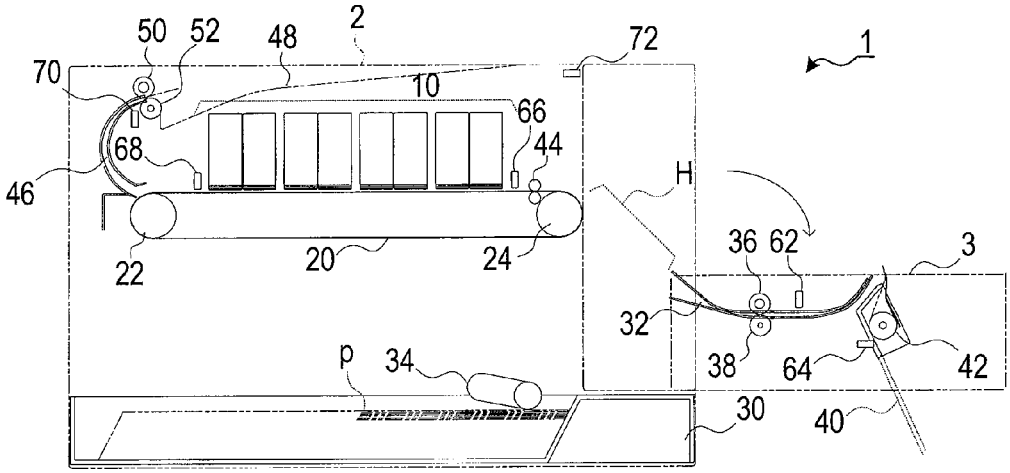
Figure 1C:
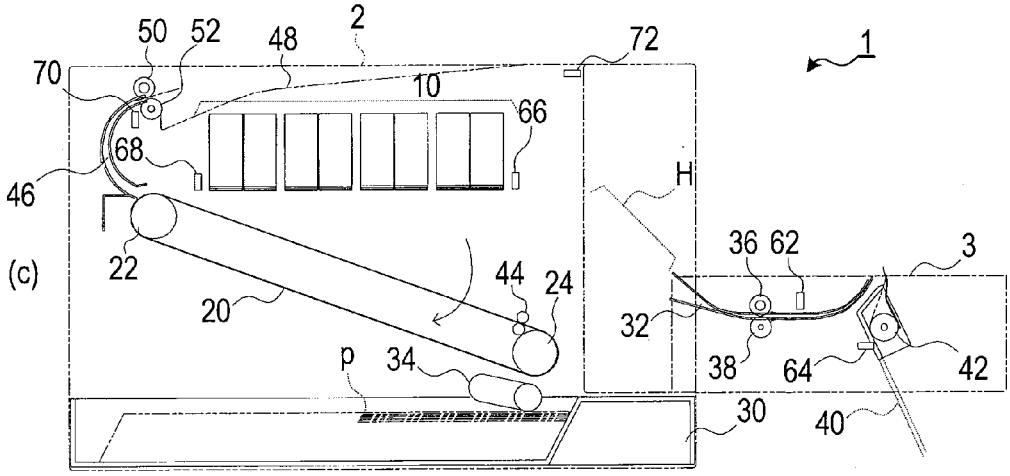

Referring to FIGS. 1A to 1C, a printer 1 of the present embodiment is a line printer that forms an image on a recording paper by conducting ejection of ink drops from head surfaces of recording heads 10 while conveying the recording paper with a recording medium conveying unit 20 along the head surfaces of the fixed recording heads 10 in a direction shown with an arrow S.

In addition to the recording heads 10 and the recording medium conveying unit 20, a housing 2 of the printer 1 comprises: a feed cassette 30 that stores recording paper p; a lower pickup roller unit 34 that picks up a recording paper p stored in the paper feed cassette 30 on a sheet by sheet basis and conveys picked up recording paper p to a paper chute 32; a feed roller 36 and a pinch roller 38 that convey the recording paper p conveyed into the paper chute 32; a manual feed pickup roller unit 42 that picks up a recording paper p set on a manual feed tray 40 on a sheet by sheet basis and conveys the picked up recording paper p toward the recording medium conveying unit 20; a pressing roller 44 that presses the recording paper p reached one end of the recording medium conveying unit 20 (the right side in FIG. 1A) against an upper surface of the recording medium conveying unit 20; an upper discharging roller 50 and a pinch roller 52 that discharge the recording paper p conveyed into an upper discharging chute 46 to an upper discharging unit 48.

On a lateral side of the housing 2 (on the right side in FIG. 1A), the housing 2 comprises a feed unit 3 that can open/close the housing 2 by pivoting upon a lower end thereof. The paper chute 32, feed roller 36, pinch roller 38, and manual feed pickup roller unit 42 are provided in one side of the feed unit 3 toward inside of the housing 2. The lateral side of the housing 2 is opened/closed by the feed unit 3 including these constituents (FIGS. 1A and 1B). When the lateral side of the housing 2 is opened, an opening H extending from outside of the printer 1 to inside of the housing 2 is provided, and the constituents disposed inside of the housing 2 are exposed to outside of the printer 1.

Inside of the housing 2, various sensors are provided to detect a state of the printer 1. A sensor 62 is provided in a supply path of a recording paper p formed by the paper chute 32 to detect passage of a recording paper p in the paper chute 32. A manual feed paper detection sensor 64 is provided on the manual feed tray 40 to detect a recording paper p is set on the manual feed tray 40. A head area entrance detection sensor 66 is provided in the first end of the recording medium conveying unit 20 to detect conveyance of a recording paper p in the first end. A head area exit detection sensor 68 is provided in the second end of the recording medium conveying unit 20 to detect conveyance of a recording paper p in the second end. A discharge sensor 70 is provided in a discharge path of a recording paper p formed by the upper discharging chute 47 to detect passage of a recording paper p in the discharging chute 46. A feed unit status detection sensor 72 is provided in the housing 2 to detect status of the feed unit 3 (open/close status).

Figure 2:
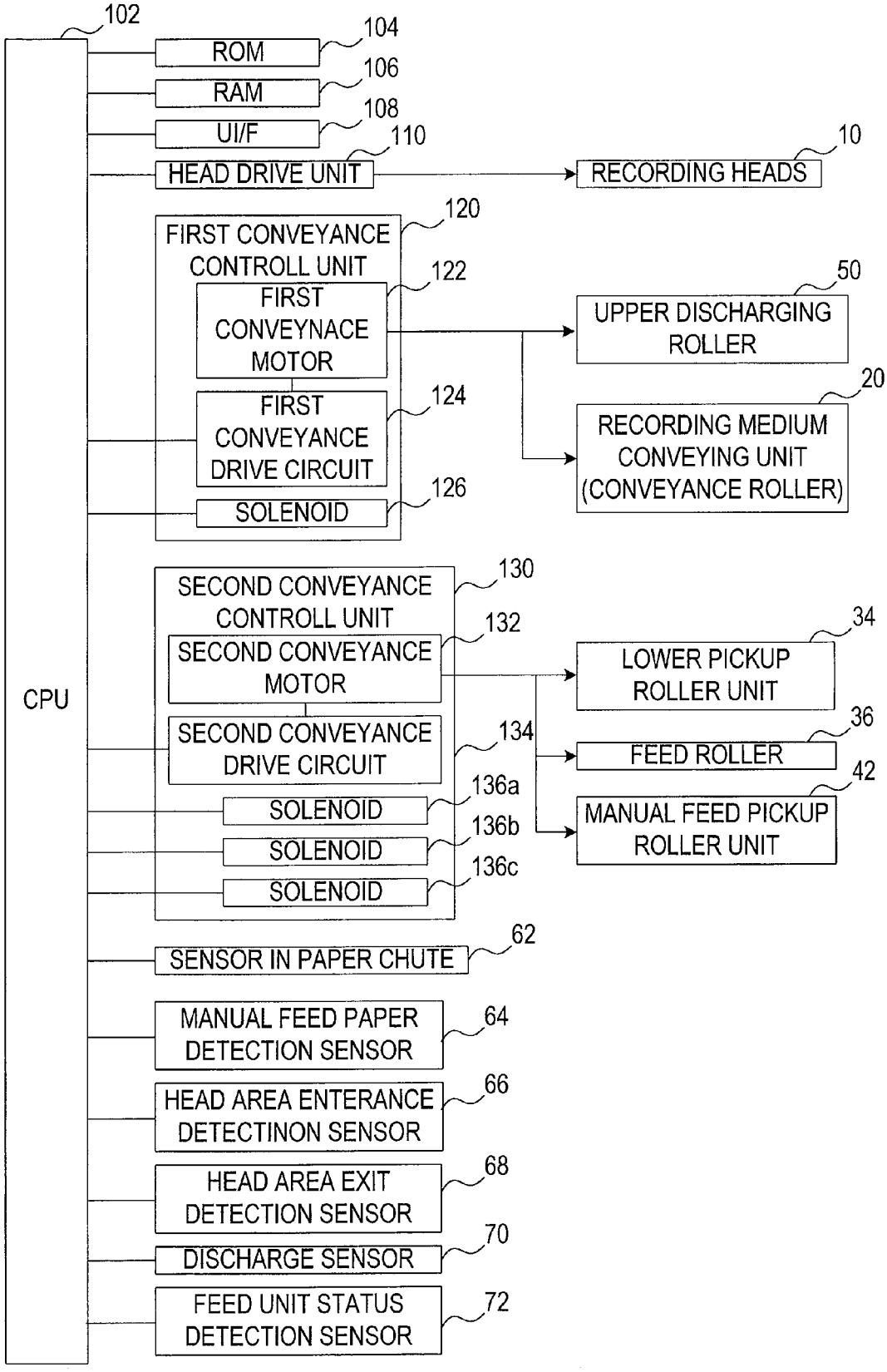
FIG. 2 is a block diagram showing a control system of the printer.

As shown in FIG. 2, for a control system of operation of the printer 1, the printer 1 furthermore comprises: CPU 102 that controls overall operation of the printer 1; ROM 104 that stores programs executed by the CPU 102; RAM 106 that stores a result of a process executed by the CPU 102; a user interface unit 108 (to be referred to as UI/F unit 108), a head drive unit 110 that drives the recording heads 10; a first conveyance control unit 120 that controls conveyance of a recording paper p by the recording medium conveying unit 20, and discharge of a recording paper p by the upper discharging roller 50; and a second conveyance control unit 130 that controls conveyance of a recording paper p by the lower pickup roller unit 34, the feed roller 36 and the manual feed pickup roller unit 42.

The UI/F 108 comprises an operation panel that receives operation by a user, and a display panel that displays information relating to the printer 1.

The head drive unit 110 is a control circuit that controls ejection of ink drops from the respective recording heads 10 corresponding to a command from the CPU 102.

The first conveyance control unit 120 comprises: a first conveyance motor 1322 that rotates a conveyance roller 22 provided on the second end (left end in FIGS. 1A to 1C) of the recording medium conveying unit 20 and the upper discharging roller 50 via a power transmission mechanism; a first conveyance drive circuit 124 that drives the first conveyance motor 122; and a solenoid 126 that is operated corresponding to a command from the CPU 102 (drive signals). The solenoid 126 constitutes one part of above-described power transmission mechanism, and operates a clutch (not shown) to move the pinch roller 52 disposed in vicinity of an exit of the discharging chute 46 to a position wherein the pinch roller 52 is pressed against the upper discharging roller 50, and to a position wherein the pressing is relieved. When commands are sent to the solenoid 126, the clutch moves the pinch roller 52 from the relieved position to the pressed position, and from the pressed position to the relieved position.

The second conveyance control unit 130 comprises: a second conveyance motor 132 that operates the lower pickup roller unit 34, feed roller 36 and manual feed pickup roller unit 42 via the power transmission mechanism; a second conveyance drive circuit 134 that drives the second conveyance motor 132; and solenoids 136*a* to 136*c* operated corresponding to a command (drive signals) from the CPU 102 to be described hereinafter.

The following describes the power transmission mechanism that transmits power of the second conveyance motor 132.

Figure 3:
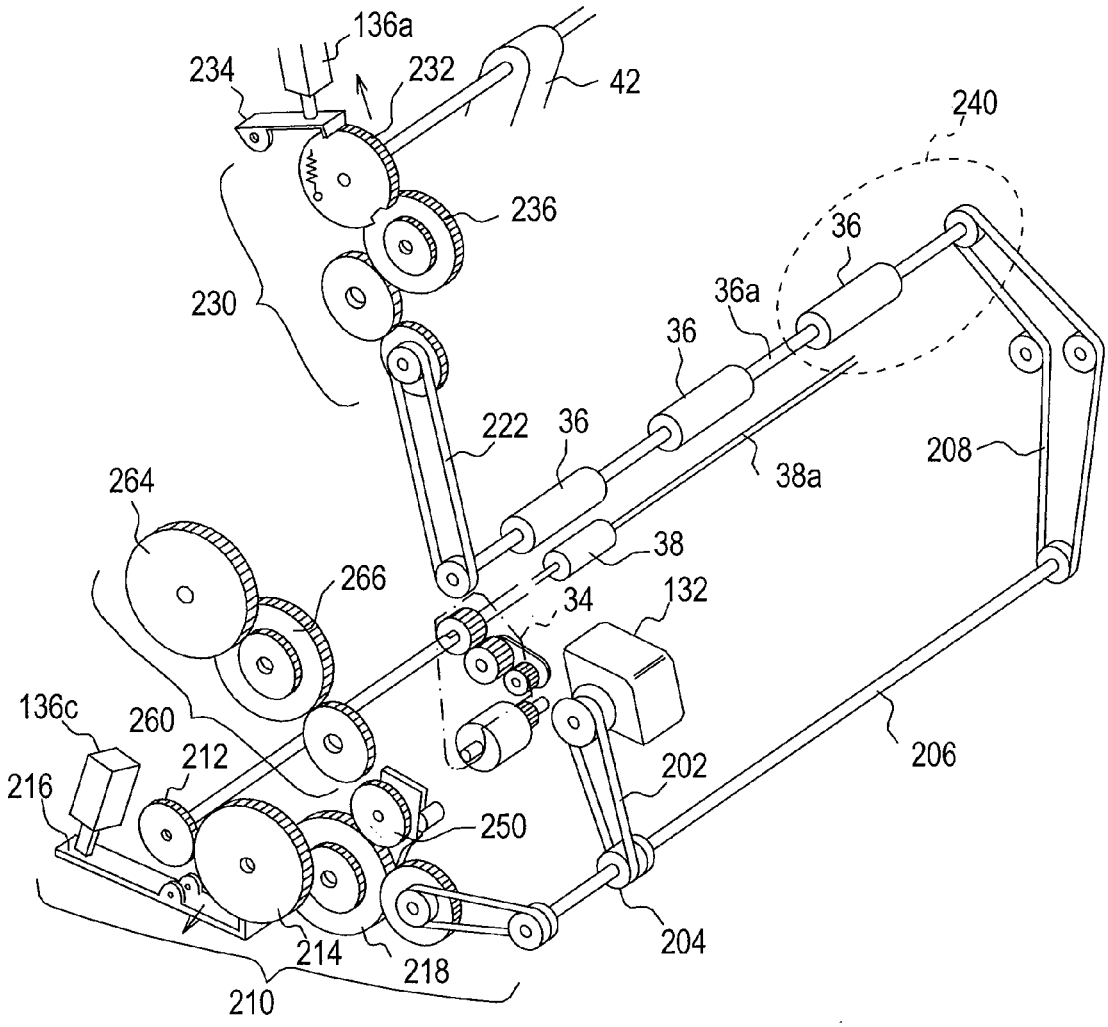
FIG. 3 is a perspective view showing a power transmission mechanism of the embodiment that transmits power of a second conveyance motor.

As shown in FIG. 3, power is transmitted in this power transmission mechanism as follows: first, power of the second conveyance motor 132 is transmitted to a shaft 206 via a timing belt 202 and a pulley 204, subsequently transmitted from one end of the shaft 206 (right side in FIG. 3) to a rotational shaft 36*a* of the feed roller 36 via the timing belt 208, and then transmitted from another end of the shaft 206 (left side in FIG. 3) to a power switch mechanism 210 to be described later.

The rotational shaft 36*a* of the feed roller 36 has one end connected to the timing belt 208. Another end thereof opposite to the end connected to the timing belt 208 is connected to a manual feed mechanism 230 via a timing belt 222. Power transmitted from the second conveyance motor 132 is transmitted to this manual feed mechanism 230.

The manual feed mechanism 230 comprises plurality of gears. A gear 232 connected to the manual feed pickup roller unit 42, a stopper 234 that regulates rotation of the gear 232, and the above-described solenoid 136*a* constitute a clutch that allows and intermits power transmission to the manual feed pickup roller unit 42. Amongst the constituents of the clutch, the gear 232 rotates by engaging with a gear 236 disposed in the timing belt 222 side. However, one area of the gear 232 along circumference thereof is formed without teeth. In this area, the gear 232 does not engage with the gear 236, and rotation thereof is stopped by the stopper 234. The solenoid 136*a* is operated so as to relieve stopping on the gear 232 by the stopper 234 when receiving a command (drive signals) from the CPU 102. The gear 232 is engaged with the gear 236 by spring contraction force. Power transmitted from the feed roller 36 is transmitted to the manual feed pickup roller unit 42 via the gears 232 and 236. The manual feed pickup roller unit 42 transmits the power transmitted from the manual feed mechanism 230 to a roller disposed a leading end of the unit 42 via plurality of gears installed therein. By rotation of the roller, a recording paper p set on the manual feed tray 40 is picked up and conveyed toward the recording medium conveying unit 20.

In one side of the rotational shaft 36*a* of the feed roller 36 connected to the timing belt 208, a roller nip mechanism 240 is provided and presses the pinch roller 38 toward the feed roller 36.

Figure 4:
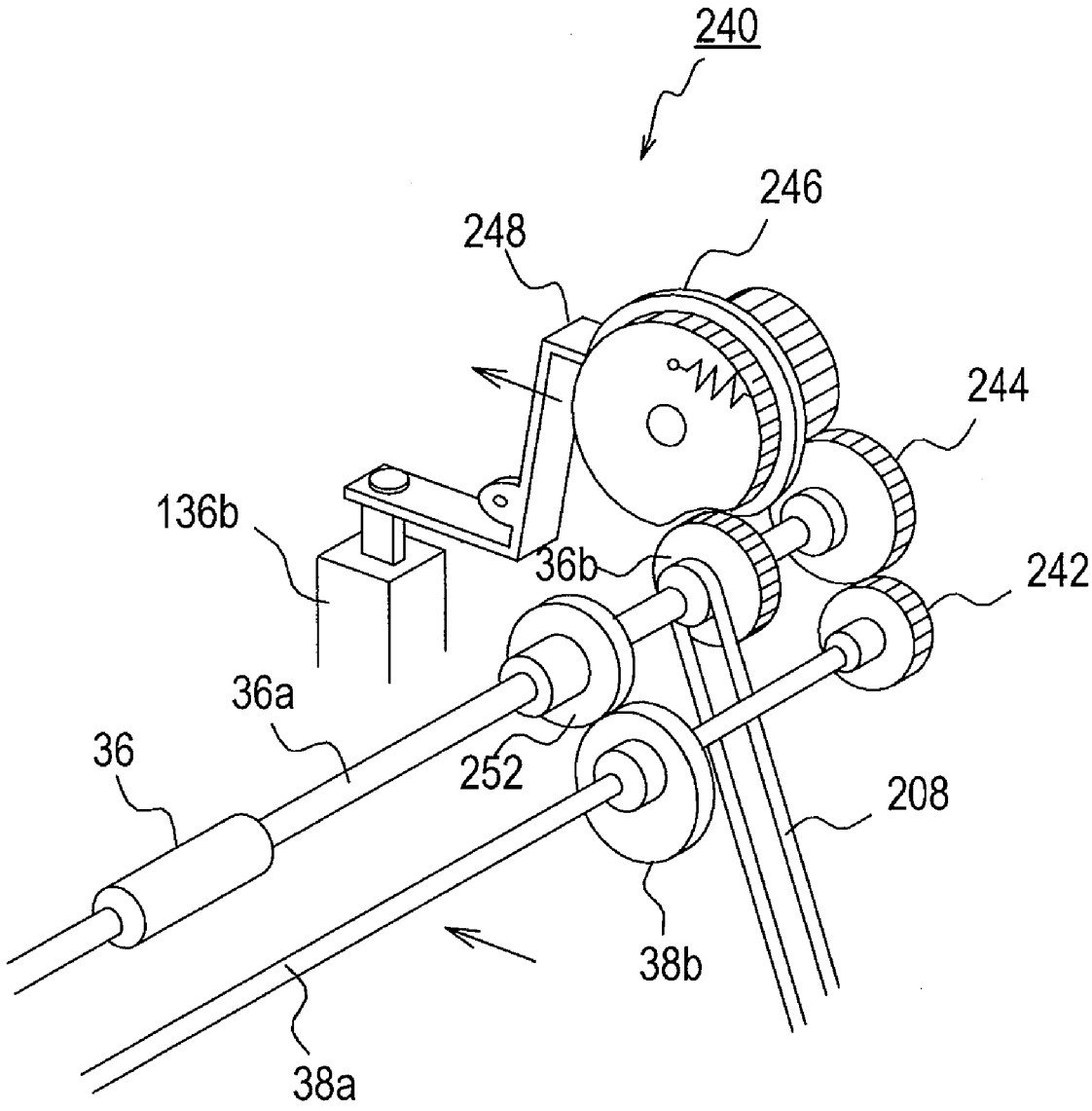
FIG. 4 is a perspective view showing a roller nip mechanism in the power transmission mechanism of the embodiment.

As shown in FIG. 4, in the roller nip mechanism 240, a clutch is constituted with a gear 242 connected with a rotational shaft 38*a* of the pinch roller 38, a gear 244 that transmits power to the gear 242, a gear 246 that transmits power of the feed roller 36 to the gear 244, a stopper 248 that stops rotation of the gear 246, and the above-described solenoid 136*b*. The clutch allows and intermits power transmission to the pinch roller 38. The gear 244 is attached to the rotational shaft 36*a* of the feed roller 36. Nevertheless, the gear 244 is constituted so as to be able to rotate independently from rotation of the rotational shaft 36*a*. The gear 246 is rotated by engaging with a gear portion of a pulley 36*b* connected with the timing belt 208, and transmits the power to the gear 244. However, in the area of the gear 246 that engages with the gear portion of the pulley 36*b*, there is one portion of the area along circumference thereof that does not have teeth. In this area, the gear 246 and the gear portion of the pulley 36*b* do not engage with each other, and rotation thereof is stopped by the stopper 248. The solenoid 136*b* is operated so as to relieve the regulation on the gear 246 by the stopper 248 when receiving a command (drive signals) from the CPU 102. Consequently, by spring contraction force, the gear 246 is engaged with the gear 244. Power of the feed roller 36 is transmitted to the rotational shaft 38*a* via the gears 246 and 244. To the rotational shaft 38*a*, an eccentric cam 38*b* is attached. The rotational shaft 38*a* moves toward the feed roller 36 and away from the feed roller 36 by rotation of the eccentric cam 38*b* while being in contact with a roller bearing 252 attached to the rotational shaft 36*a* of the feed roller 36. When the rotational shaft 38*a* is rotated so as to be near the feed roller 36, the pinch roller 38 can be pressed against the feed roller 36. When the rotational shaft 38*a* is rotated so as to be away from the feed roller 36, the pressing against the feed roller 36 can be relieved.

The above-described power transmission mechanism 210 comprises plurality of gears. A gear 212 connected to the lower pickup roller unit 34, a gear 214 that transmits power to the gear 212, a stopper 216 that stops rotation of the gear 214, and the above-described solenoid 136*c* constitute a clutch that allows and intermits power transmission to the lower pickup roller unit 34. Amongst these constituents, the gear 214 rotates by engaging with a gear 218 driven by the second conveyance motor 132. One portion of the gear 214 along circumference thereof does not have teeth, and this area does not engage with the gear 218. In this area, rotation of the gear 214 is stopped by the stopper 216. The solenoid 136*c* is operated so as to relieve regulation on the gear 214 by the stopper 216 when receiving a command (drive signals) from the CPU 102. Consequently, by spring contraction force, the gear 214 is engaged with the gear 218 driven by the second conveyance motor 132, and power transmitted from the second conveyance motor 132 via these gears 214 and 218 is transmitted to the lower pickup roller unit 34. The lower pickup roller unit 34 transmits power transmitted from the power switch mechanism 210 to a roller disposed at a leading end thereof via plurality of gears installed therein. By rotations of this roller, a recording paper p stored in the feed cassette 30 is picked up and conveyed toward recording medium conveying unit 20.

The power switch mechanism 210 has a planet gear 250 that moves by rotation of the gear 218, and transmits power transmitted when the second conveyance motor 132 is rotated in a clockwise direction (CW) to a rotation drive mechanism 260.

Figure 5:
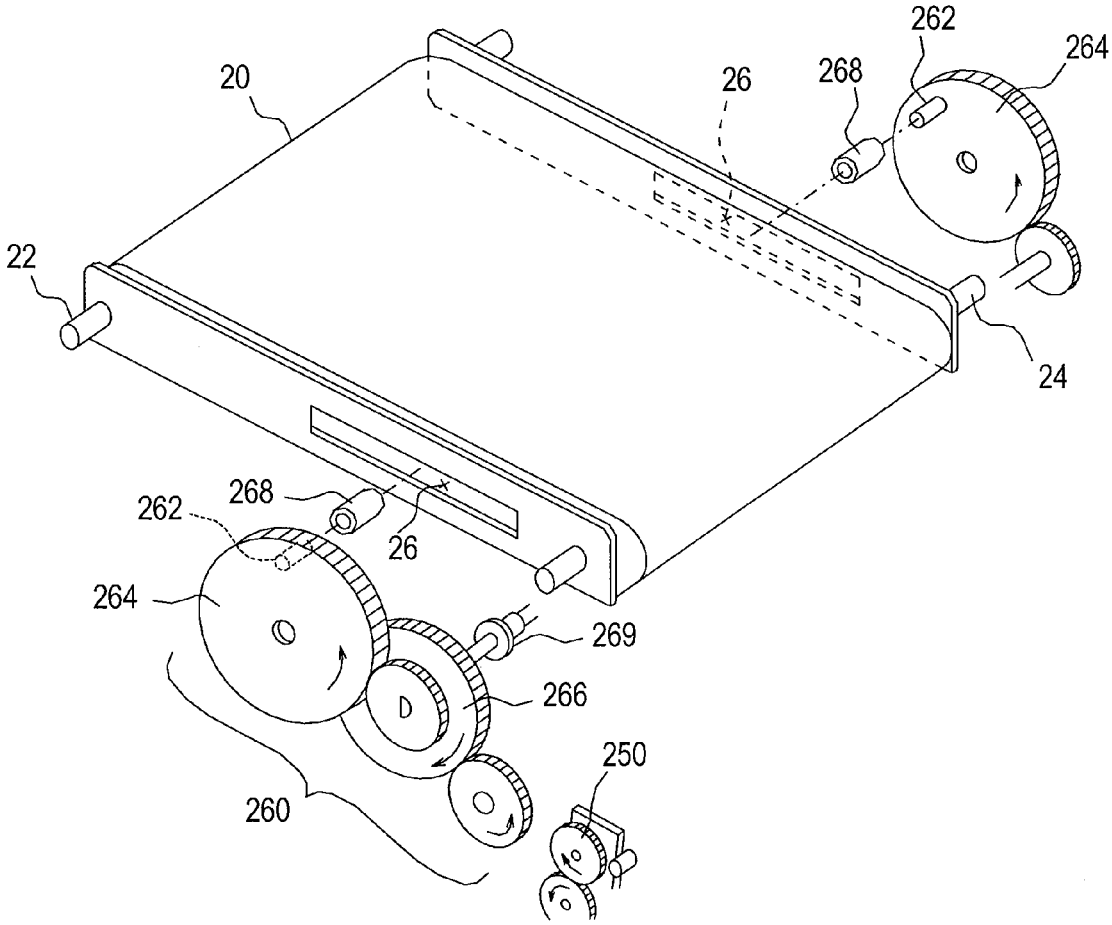
FIG. 5 is a perspective view showing a rotation drive mechanism in the power transmission mechanism of the embodiment.

As shown in FIG. 5, in the rotation drive mechanism 260, one pair of cam gears 264 each having a sliding protrusion 262 formed thereon are provided to sandwich the recording medium conveying mechanism 20 therebetween. The sliding protrusions 262 are respectively inserted, via bearings 268, into groove portions 26 formed along a conveyance direction of a recording paper p on lateral surfaces of the recording medium conveying unit 20. In this constitution, the sliding protrusions 262 can slide in the groove portions 26 corresponding to rotation of the cam gears 264 and transmit vertical power to the recording medium conveying unit 20. In the present embodiment, in the recording medium conveying unit 20, the conveyance roller 24 provided on one end thereof works as a free end, and the conveyance roller 22 disposed on the other end works as a rotational axis. Specifically, by the cam gears 264 being rotated for ½ rotation from an initial status, the recording medium conveying unit 20 is rotated on the conveyance roller 22 and moves to a remote position (FIG. 1C) away from the head surfaces of the recording heads 10. Subsequently, when the cam gears 264 are furthermore rotated for another ½ rotation, the recording medium conveying unit 20 is rotated in an opposition direction, and moves up to a proximate position (FIG. 1B) proximate to the head surfaces of the recording heads 10. That is, by rotating the cam gears 264 for one rotation from the initial status, the rotation drive mechanism 260 operates so as to move the recording medium conveying unit 20 from the proximate position to the remote position, and return the recording medium conveying unit 20 to the proximate position. Rotational direction of the gear 266 that transmits power to the cam gears 264 is regulated only in a certain direction by a one-way clutch 269. Therefore, the recording medium conveying unit 20 does not move toward the remote position because of weight thereof.

Figure 6A:
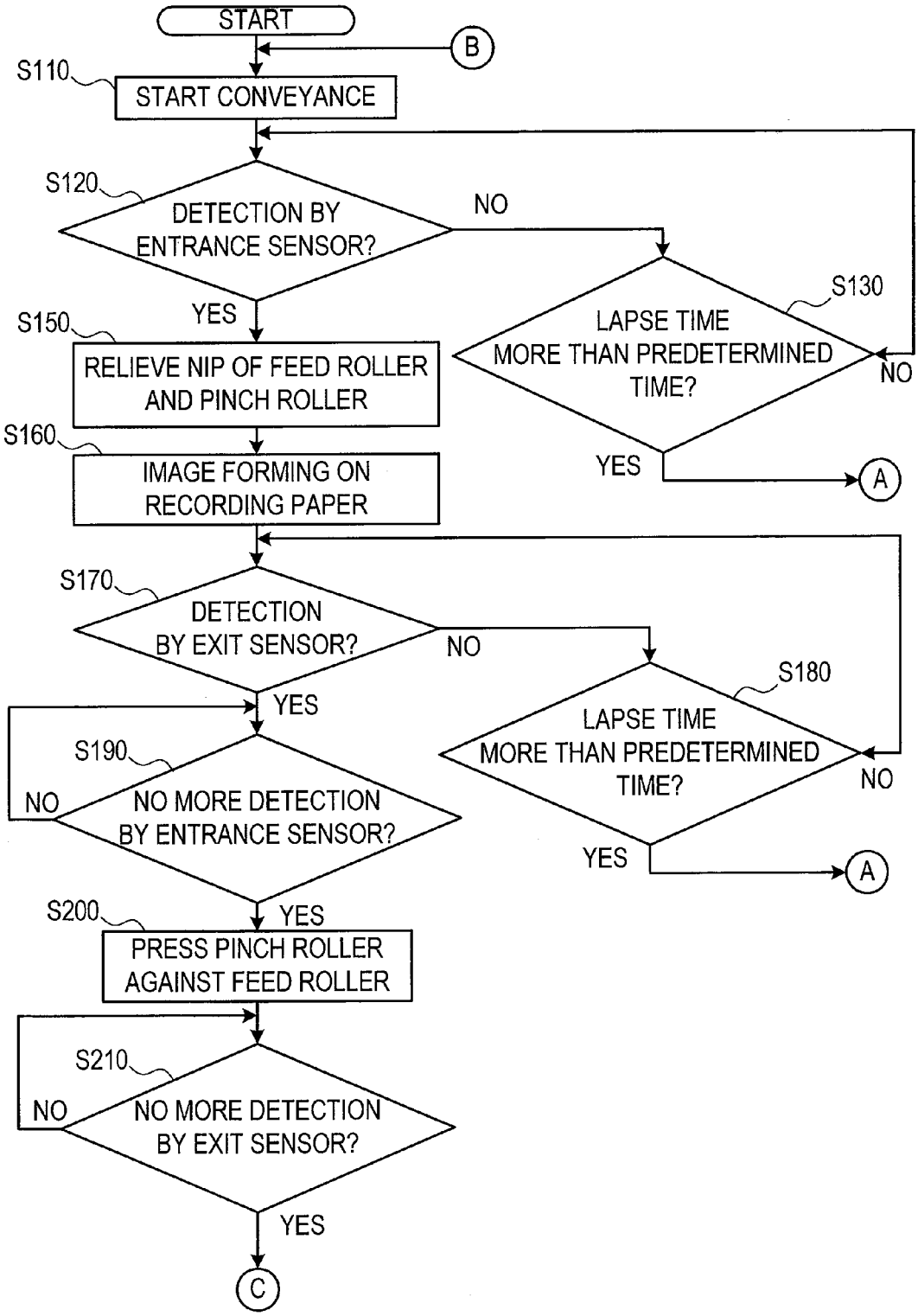
FIGS. 6A and 6B are flowcharts showing operation procedures of an image forming process of the embodiment.
Figure 6B:
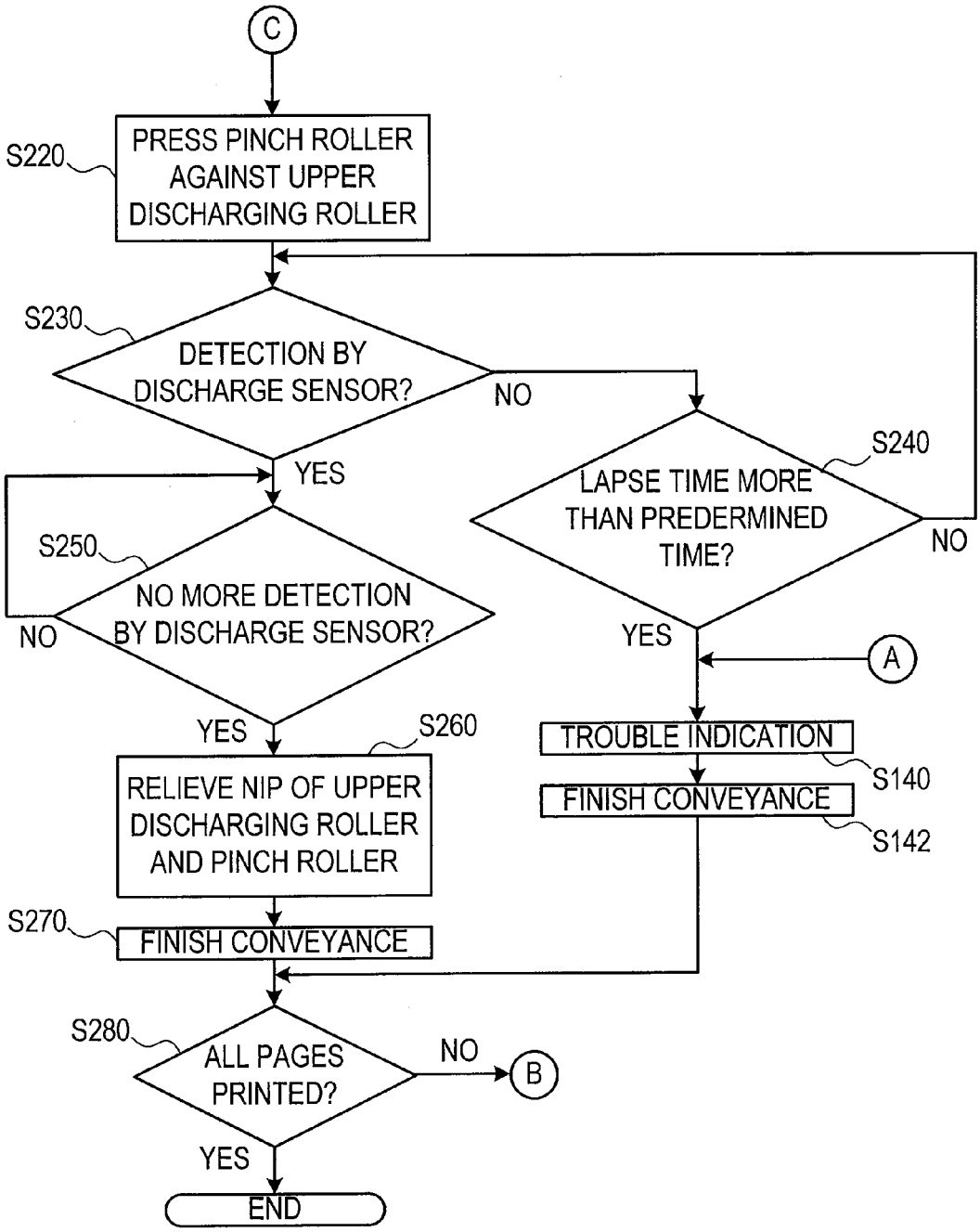

Based on FIGS. 6A and 6B, the following describes an image forming process executed by the CPU 102 when an external command to print an image is inputted.

Firstly, in S110, conveyance operation is initiated. In this step, rotation of the first conveyance motor 122 is initiated by the first conveyance drive circuit 124, and consequently the recording medium conveying unit 20 (conveyance roller 22) and the upper discharging roller 50 are operated. At this time, a command to the solenoid 126 is not sent. Thus, the clutch is not operated, and pressing of the pinch roller 52 against the upper discharging roller 50 is relieved. Moreover, in this step, rotation of the second conveyance motor 132 is initiated by the second conveyance drive circuit 134, consequently, the feed roller 36 is rotated and conveyance of a recording paper p is initiated by commands to respective solenoids 136*a* to 136*c*. Specifically, the solenoid 136*c* of the power switch mechanism 210 is operated for specific period of time so that the lower pickup roller unit 34 picks up a recording paper p. The solenoid 136*b* of the roller nip mechanism 240 is operated to rotate (½ rotation) the pinch roller 38 so that the pinch roller 38 presses against the feed roller 36. It is to be noted that the second conveyance motor 132 is rotated in a counterclockwise direction (CCW) in the present image forming process.

By initiating operation of respective units or portions, conveyance of a recording paper p from the feed cassette 30 is initiated and conveyance of the recording paper p up to the upper discharging unit 48 becomes possible.

In S120, the head area entrance detection sensor 66 checks whether or not conveyance of a recording paper p by the recording medium conveying unit 20 is initiated. If conveyance is not detected (S120: NO), and if lapse time since the conveyance is initiated by the process in S110 has not yet reached predetermined time (5 seconds in the present embodiment) (S130: NO), the process goes back to S120. If the lapse time has reached the predetermined time or has become longer (S130: YES), the process proceeds to S140 and an alarm is made to announce that some kind of trouble has occurred to the recording paper p during conveyance. A message is shown on the display panel of UI/F 108 to announce a trouble is caused. A trouble here to be alarmed can be a jam of a recording paper p in a path between the feed cassette 30 and the first end of the recording medium conveying unit 20.

After the process in S140, conveyance is finished in S142, and the image forming process is terminated. In S142, the first conveyance drive circuit 124 stops rotation of the first conveyance motor 122, and the second conveyance drive circuit 134 stops rotation of the second conveyance motor 132. Correspondingly, rotation of respective rollers is stopped.

On the other hand, if the head area entrance detection sensor 66 detects that conveyance of a recording paper p is initiated (S120: YES), the solenoid 136*b* in the roller nip mechanism 240 is operated to relieve pressing of the pinch roller 38 against the feed roller 36 (nipping between the pinch roller 38 and the feed roller 36). Consequently, in S150, the conveyance of the recording paper p by the feed roller 36 and the pinch roller 38 is finished. The pressing of the pinch roller 38 against the feed roller 36 is relieved by operating the solenoid 136*b* for specific period of time and by rotating the rotational shaft 38*a* (½ rotation).

Subsequently, in S160, image forming on a recording paper p is conducted by the head drive unit 110 driving the recording heads 10 corresponding to conveyance of the recording paper p by the recording medium conveying unit 20, and by respective recording heads 10 ejecting ink drops.

In S170, it is determined whether or not the head area exit sensor 68 has detected a recording paper p being conveyed to the second end of the recording medium conveying unit 20. If the recording paper p has not yet been detected (S170: NO), and the lapse time since initiation of conveyance of a recording paper p by the recording medium conveying unit 20 was detected in S120 has not reached a predetermined time corresponding to time necessary for the recording medium conveying unit 20 to convey a recording paper p from the first end thereof to the second end (S180: NO), the process goes back to S170. If the lapse time has reached the predetermined time (S180: YES), the process goes to S140 to announce that some kind of trouble is caused on the recording paper p during conveyance. A trouble here to be announced can be a jam of a recording paper p in a path on the recording medium conveying unit 20.

On the other hand, if a recording paper p is detected by the head area exit detection sensor 68 (S170: YES), in S190, the CPU 102 stands by until the head area entrance detection sensor 66 no longer detects conveyance of a recording paper p. When detection is no longer found (S190: YES), the solenoid 136*b* in the roller nip mechanism 240 is operated and the rotational shaft 38*a* is pressed against the feed roller 36, and conveyance of subsequent recording paper p by the feed roller 36 can be ready in S200. The pinch roller 38 is pressed against the feed roller 36 by rotating the rotational shaft 38*a* (½ rotation) as described in S110.

In S210, the CPU 102 stands by until the head area exit detection sensor 68 no longer detects conveyance of a recording paper p. When detection is no longer found (S210: YES), the solenoid 126 in the first conveyance control unit 120 is operated to press the pinch roller 52 against the upper discharging roller 50, and discharging of a recording paper p by the upper discharging roller 50 can be ready in S220.

In S230, The CPU 102 checks whether or not the discharge sensor 70 has detected conveyance of a recording paper p up to the upper discharging chute 46. If conveyance has not yet detected (S230: NO), and lapse time since conveyance of a recording paper p was no longer detected by the head area exit detection sensor 68 in S190 has not yet reached a predetermined time necessary for a recording paper p to reach inside of the discharging chute 46 (S240: NO), the process goes back to S230. If the lapse time has reached the predetermined value (S240: YES), the process goes to S140 to announce that some kind of trouble is caused on a recording paper p during conveyance. A trouble here to be announced can be a jam of a recording paper p in the upper discharging chute 46.

On the other hand, if conveyance of a recording paper p up to the upper discharging chute 46 is detected (S230: YES), the CPU 102 stands by until conveyance of a recording paper p is no longer detected by the discharge sensor 70. When detection is no longer found (S250: YES), in S260, the solenoid 126 in the first conveyance control unit 120 is operated for specific period of time to relieve pressing of the pinch roller 52 against the upper discharge roller 50. Thereby discharge of a recording paper p by the upper discharge roller 50 is not conducted.

In S270, by stopping rotation of the first conveyance motor 122 and the second conveyance motor 132 in the same manner as the process in S142, corresponding rollers are stopped and conveyance is finished.

In S280, it is checked whether or not all images commanded to be printed on recording paper p have been formed (all pages have been printed). If not all the images have been formed (S280: NO), the process goes back to S110. If all the image have been formed (S280: YES), the image forming process is completed.

In the above-described image forming process, the recording paper p is fed to the recording medium conveying unit 20 from the feed cassette 30. However, it is also possible to feed recording paper p as follows: if the manual feed paper detection sensor 64 detects a recording paper p set on the manual feed tray 40, or if setting is made to use a recording paper p set on the manual feed tray 40, in S110, rotation of the second conveyance motor 132 is initiated by the second conveyance drive circuit 134, and the solenoid 136*a* in the manual feed mechanism 230 is operated for specific period of time to pick up a recording paper p by the manual feed pick roller unit 42. In this case, processes of S150 and S200 can be skipped.

Figure 7:
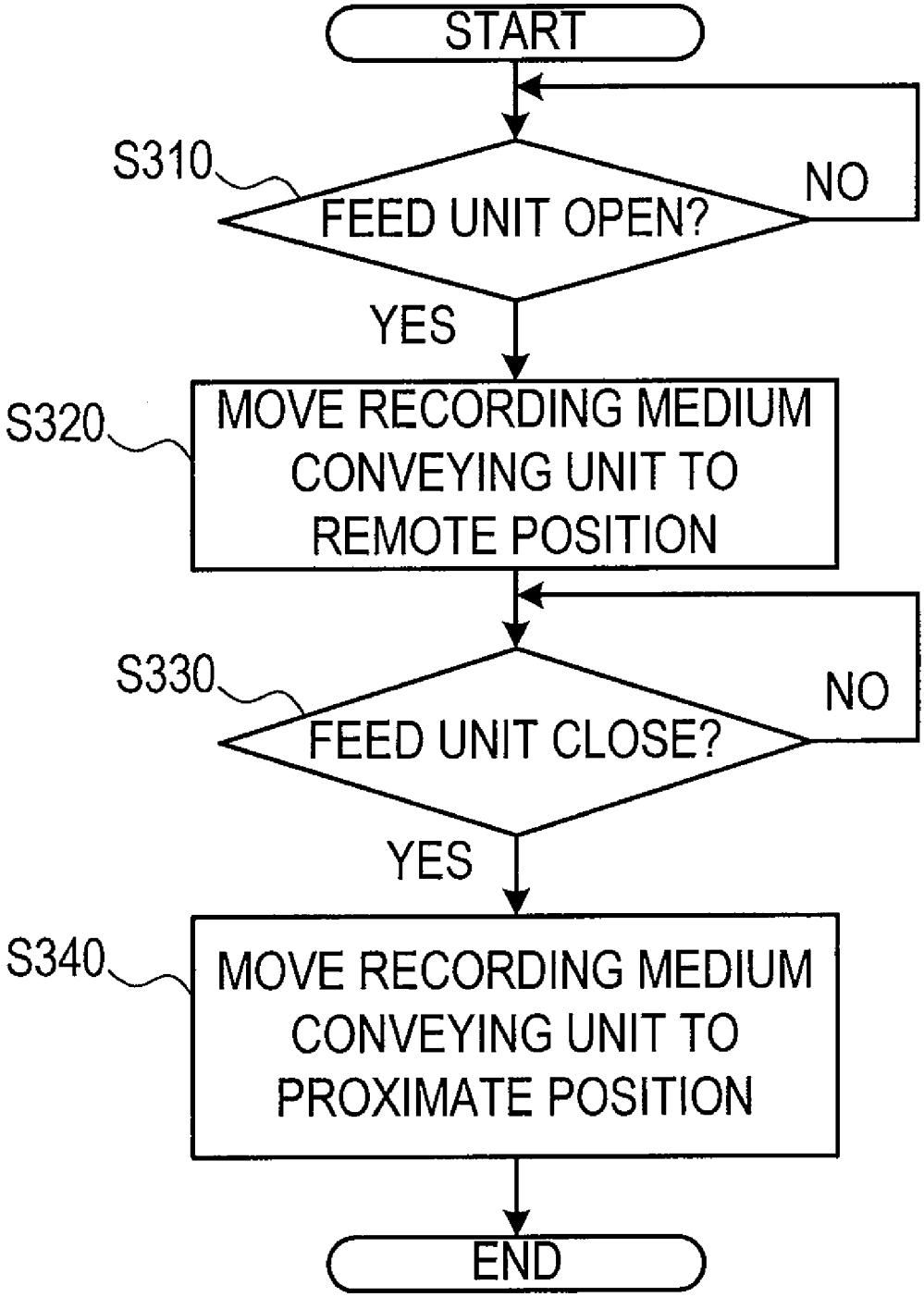
FIG. 7 is a flowchart showing operation procedures of a remote/proximate process of the embodiment.

Based on FIG. 7, the following describes remote/proximate process repeatedly conducted after the printer 1 is started up.

In S310, the CPU 102 stands by until the feed unit status detection sensor 72 detects an open status of the feed unit 3. The feed unit 3 is opened by a user for removing a recording paper p between the head surfaces of the recording heads 10 and the recording medium conveying unit 20, i.e. for an unjamming process. Thus the feed unit 3 is opened after there is an alarm to announce that a trouble is caused in the image forming process as described above.

When the feed unit 3 is detected to be open (S310: YES), in S320, the recording medium conveying unit 20 is moved from the proximate position to the remote position. For this movement, the second conveyance drive circuit 134 rotates the second conveyance motor 132 in the clockwise direction (CW) for specific period of time. Power generated by the second conveyance motor 132 is transmitted, as described above, to the cam gear 264 in the rotation drive mechanism 260 via the planet gear 250 in the power switch mechanism 210. In S320, the second conveyance motor 132 is rotated for a period of time necessary for the cam gears 264 to move the recording medium conveying unit 20 from the proximate position to the remote position, i.e. for a period of time defined to be necessary to rotate the cam gears 264 for ½ rotation. Consequently, the recording medium conveying unit 20 moves from the proximate position (FIG. 1B) to the remote position (FIG. 1C).

After the recording medium conveying unit 20 moves to the remote position, an opening H formed by the opened feed unit 3 is extended up to a space between the head surfaces of the recording heads 10 and the recording medium conveying unit 20 (FIG. 1C). Subsequently, a recording paper p jammed in this space can be taken outside of the printer 1. After a recording paper p jammed in the space between the head surfaces of the recording heads 10 and the recording medium conveying unit 20 is taken outside by a user, the feed unit 3 is closed.

In S330, the CPU 102 stands by until the feed unit status detection sensor 72 detects that the feed unit 3 is closed.

When it is detected that the feed unit 3 is closed (S330: YES), in S340, the recording medium conveying unit 20 is moved from the remote position to the proximate position. For this purpose, the second conveyance drive circuit 134 again rotates the second conveyance motor 132 in the clockwise direction (CW) for specific period of time. In S340, the second conveyance motor 132 is rotated in the clockwise direction for specific time necessary for the cam gears 264 to move the recording medium conveying unit 20 from the remote position to the proximate position, i.e. for specific time defined to be necessary to furthermore rotate the cam gears 264 for ½ rotation. Consequently, the recording medium conveying unit 20 is moved from the remote position to the proximate position.

[Effect]

According to the printer 1 constituted as above, a recording paper p jammed between the recording medium conveying unit 20 and the head surfaces can be removed while the head surfaces of the recording head 10 and the recording medium conveying unit 20 are parted. An unjamming process to remove the recording paper p is conducted through the opening H formed on the lateral side of the housing 2. Consequently, the recording medium conveying unit 20 is not exposed outside. Compared to a constitution wherein the recording heads 10 are lifted up to provide a vertically large space between the recording heads 10 and the recording medium conveying unit 20, it is possible to inhibit dust from entering inside of the printer 1 to a greater extent.

Moreover, in the present printer 1, an unjamming process becomes possible by moving the recording medium conveying unit 20 away from the head surfaces. Unlike the constitution wherein the recording heads 10 are displaced, large vibration or shock is less likely applied to the recording heads 10 when removal of a recording paper p is conducted.

This constitution is very effective especially in an inkjet printer wherein ink drops are ejected from the recording heads 10. For accurate control over ejection of ink drops, it is necessary, in an inkjet printer, that menisci are always formed on respective nozzles provided on the recording heads 10 so that ink drops are always ready to be ejected. If large vibration or shock is applied to the recording heads 10 during an unjamming process, menisci of ink in respective nozzles cannot be maintained, and ejection of subsequent ink drops might not be controlled accurately. With the constitution of the present printer 1 wherein the recording medium conveying unit 20 is moved away from the head surfaces, large vibration or shock is less likely applied to the recording heads 10 during an unjamming process. Therefore, menisci in the nozzles are not broken, and ejection of ink drops can be accurately controlled.

Furthermore, if a printer has a constitution wherein respective nozzles of the recording heads 10 are connected to an ink tank via supply path of respective ink, pressure applied on menisci differ depending on height difference (head difference) between the ink tank and the nozzles. When positional relation between the recording heads 10 and the ink tank changes, pressure within the supply path fluctuates. Depending on the fluctuation, menisci cannot be maintained. Consequently, subsequent ejection of ink drops cannot be accurately controlled. However, with the present printer 1, positional relation between the recording heads 10 and the ink tank do not change during an unjamming process. Therefore, menisci are always maintained to be ready for ejection, and ejection of ink drops can be accurately controlled.

Still furthermore, the housing 2 of the printer 1 is provided with a feed unit 3 that covers/uncovers the opening H. By keeping the opening covered with this feed unit 3 except during an unjamming process, it is possible to reliably inhibit dust from entering inside of the printer 1.

Displacement of the recording medium conveying unit 20 from the proximate position to the remote position is automatically conducted when the feed unit 3 is detected to be opened (in S320 in FIG. 7). Displacement of the recording medium conveying unit 20 from the remote position to the proximate position is automatically conducted when the feed unit 3 is detected to be closed (in S340 in FIG. 7). An unjamming process can be easily initiated simply by opening the feed unit 3. After removal of a recording paper p, the unjamming process can be easily finished simply by closing the feed unit 3.

In the feed unit 3, the paper chute 32, feed roller 36, pinch roller 38, and manual feed pickup roller unit 42 are provided toward the internal side of the housing 2. The space for providing the feed unit 3 and the space as a supply path of the recording paper p are integrated. Compared to a constitution wherein these spaces are separately provided, the printer 1 can be constituted compactly.

The feed unit 3 opens/closes the lateral side of the housing 2 together with theses constituents disposed therein. When the feed unit 3 is opened, these constituents are exposed outside of the printer 1. Thereby, when a recording paper p is jammed in a supply path constituted with these constituents, an unjamming process from this supply path can be easily conducted.

In the process wherein a recording paper p is conveyed in the image forming process shown in FIGS. 6A and 6B, when a recording paper p is conveyed to the recording medium conveying unit 20 by the feed roller 36 and the pinch roller 38, that is when conveyance of the recording paper p by the recording medium conveying unit 20 is initiated, nipping between the feed roller 36 and the pinch roller 38 is relieved (S150), and conveyance of the recording paper p by the feed roller 36 and the pinch roller 38 is no longer conducted. Consequently, even if respective conveyance speed of the recording medium conveying unit 20 and the feed roller 36 become different because of an error or deterioration, it is unlikely that a recording paper p is strained or slacked during conveyance. Therefore, it is possible to inhibit a damage on a recording paper p.

Still furthermore, the second conveyance motor 132 can drive plurality of constituents via the power transmission mechanism: such as to move the recording medium conveying unit 20 to the proximate position or to the remote position, to rotate the feed roller 36, and to press the pinch roller 38 against the feed roller 36. Therefore, number of motor to drive respective constituents of the printer 1 can be reduced.

[Variation]

The present invention is not limited to the above-described embodiment. Variations and modifications are possible within the scope of the present invention.

For example, in the above-described embodiment, movement of the recording medium conveying unit 20 from the proximate position to the remote position and from the remote position to the proximate position is automatically conducted corresponding to the open/close status of the feed unit 3. Alternatively, the recording medium conveying unit 20 can be moved from the proximate position to the remote position and from the remote position to the proximate position when, for example, a specific operation is conducted to the UI/F 108.

Moreover, in the above-described embodiment, the recording medium conveying unit 20 is moved to the remote position or the proximate position by rotating the entire recording medium conveying unit 20 on the rotational axis of the conveyance roller 22 disposed on one end of the recording medium conveying unit 20. Constitution in order to move the recording medium conveying unit 20 to the proximate position and to the remote position is not limited to this constitution. It is also possible, for example, to adopt a constitution wherein the top surface of the recording medium conveying unit 20 moves away from the head surfaces in parallel.

What is claimed is:

1. A printer comprising:

recording heads configured to record an image on a recording medium;

a recording medium conveying unit configured to convey the recording medium along head surfaces of the recording heads;

a displacement device configured to displace the recording medium conveying unit to a proximate position proximate to the head surfaces, and to a remote position away from the head surfaces; and a housing that stores the recording heads, the recording medium conveying unit and the displacement device, the housing comprising:

an aperture formed on a lateral side thereof and a cover that covers the aperture; and a motor configured to rotate in a first direction and in a second direction opposite to the first direction; and a planet gear configured to receive rotation in the first direction and the second direction from the motor, wherein the planet gear is configured such that, when the planet gear receives the rotation in the first direction, the planet gear does not transmit the rotation to the displacement device and, when the planet gear receives the rotation in the second direction, the planet gear transmits the rotation to the displacement device to displace the recording medium conveying unit from the proximate position to the remote position.

2. The printer as set forth in claim 1, wherein the cover comprises at least one part of a supply path formed to supply the recording medium to the recording medium conveying unit when the opening is covered.

3. The printer as set forth in claim 2, further comprising a recording medium supply cassette, wherein the supply path is one part of a path from the recording medium supply cassette to the recording heads.

4. The printer as set forth in claim 2, wherein the cover further comprises a manual feed recording medium supply path.

5. The printer as set forth in claim 1, further comprising:

a first sensor configured to detect the recording medium entering a recording area of the recording heads;

a second sensor configured to detect the recording medium having gone out of the recording area; and an alarm device configured to indicate a trouble when time between detection outputted from the first sensor and detection outputted from the second sensor becomes longer than predetermined time.

6. The printer as set forth in claim 1, wherein the displacement device is configured to displace the recording medium conveying unit to the remote position and to the proximate position by rotating the recording medium conveying unit on one end thereof.

7. The printer as set forth in claim 1, further comprising a supply unit having a conveyance roller configured to hold and convey the recording medium disposed in a supply path to supply the recording medium to the recording medium conveying unit, wherein the conveyance roller releases holding of the recording medium when the recording medium is supplied from the supply unit to the recording medium conveying unit.

8. The printer as set forth in claim 7, wherein the displacement device, the supply unit and the conveyance roller are driven by a single motor.

9. The printer as set forth in claim 1, wherein the displacement device is configured to displace the recording medium conveying unit differently from a direction of movement of said cover.

10. The printer as set forth in claim 1, wherein the recording heads include liquid ink.

11. The printer as set forth in claim 1, the displacement device being configured to move the recording medium conveying unit in a downward direction away from the head surfaces.

12. The printer as set forth in claim 1, wherein the displacement device has a driving device.

13. The printer as set forth in claim 1, wherein the recording medium conveying unit is configured to convey the recording medium in a substantially horizontal position beneath the head surfaces of the recording heads.

14. The printer as set forth in claim 1, wherein the displaceable recording medium conveying unit is not attached to the cover.

15. The printer set forth in claim 1, further comprising:

a detector that detects opening and closing of the cover, wherein the recording medium conveying unit displaces between the proximate position and the remote position within the housing when one of the opening and closing of the cover is detected by the detector.

16. The printer as set forth in claim 15, wherein the displacement device has a driving device configured to displace the recording medium conveying unit to the remote position when the opening of the cover is detected by the detector so that the recording medium is capable of being removed outside of the printer through the aperture.

17. The printer as set forth in claim 16, wherein the displacement device has a second driving device configured to displace the recording medium conveying unit to the proximate position when closing of the cover is detected by the detector.

18. The printer set forth in claim 1, wherein the cover is configured to freely cover and uncover the opening, and configured to allow the recording medium to be removed outside of the printer when the recording medium conveying unit is positioned at the remote position.

19. The printer set forth in claim 1, further comprising:

a supply unit having a conveyance roller configured to hold and convey the recording medium disposed in a supply path to supply the recording medium to the recording medium conveying unit, wherein the planet gear is configured such that, when the planet gear receives the rotation in the first direction, the planet gear transmits the rotation to the conveyance roller to be driven to convey the recording medium.

20. The printer set forth in claim 1, wherein the displacement device further comprises:

a groove portion extending along a conveyance direction of the recording medium in the recording medium conveying unit; and a rotatable cam gear having a protrusion that protrudes in a direction intersecting with the rotation direction, the protrusion being inserted into the groove portion in a slidable manner.

* * * * *